United States Patent [19]

Tanel

[11] Patent Number: 4,748,752

[45] Date of Patent: Jun. 7, 1988

[54] FLEXIBLE SOLE FOR PIVOTING ATHLETIC SHOE

[75] Inventor: Michael L. Tanel, Milwaukee, Wis.

[73] Assignee: Tanel Corporation, Milwaukee, Wis.

[21] Appl. No.: 3,857

[22] Filed: Jan. 16, 1987

Related U.S. Application Data

[63] Continuation-in-part of Ser. No. 800,740, Nov. 22, 1985, Pat. No. 4,660,304, and Ser. No. 854,409, Apr. 21, 1986, Pat. No. 4,669,204, said Ser. No. 800,740, is a continuation-in-part of Ser. No. 565,746, Dec. 27, 1983, Pat. No. 4,577,422, said Ser. No. 854,409, is a continuation-in-part of Ser. No. 800,740.

[51] Int. Cl.[4] ..... A43B 5/02; A43B 5/00; A43C 15/16

[52] U.S. Cl. ..... 36/126; 36/128; 36/134

[58] Field of Search ..... 36/32 R, 126, 127, 128, 36/129, 134, 59 C, 59 R, 67 R, 67 A

[56] References Cited

U.S. PATENT DOCUMENTS

| | | | |
|---|---|---|---|
| D. 171,130 | 12/1953 | Gruner | D2/320 |
| 825,869 | 7/1906 | Sandeman | 36/132 |
| 844,057 | 2/1907 | Tillinghast | 36/132 |
| 1,552,022 | 9/1925 | Willson | 36/59 C |
| 2,677,905 | 5/1954 | Dye | 36/134 |
| 2,678,507 | 5/1954 | Dye | 36/134 |
| 3,466,763 | 9/1969 | Levin | 36/134 |
| 4,266,349 | 5/1981 | Schmohl | 36/32 R |
| 4,347,674 | 9/1982 | George | 36/127 |
| 4,577,422 | 3/1986 | Tanel | 36/126 |

FOREIGN PATENT DOCUMENTS

| | | | |
|---|---|---|---|
| 1193282 | 5/1970 | United Kingdom | 36/128 |

*Primary Examiner*—Steven N. Meyers
*Attorney, Agent, or Firm*—Peter N. Jansson

[57] ABSTRACT

An improved flexible sole for athletic shoes for field sports of the type having an annular cleat providing improved pivotability and excellent traction. The annular cleat has opposed breaks along its distal edge in opposed main lateral portions which are centered on the juncture of the ball-of-the foot and toe portions of the sole. In one embodiment, a wide single break on each side of the shoe extends to the main sole surface and forms a flexing region across the sole. In another, a pair of breaks on each side form opposed annular cleat side portions, with which a central cleat may be aligned.

16 Claims, 2 Drawing Sheets

FLEXIBLE SOLE FOR PIVOTING ATHLETIC SHOE

RELATED APPLICATIONS

This is a continuation-in-part of my copending patent application Ser. No. 800,740, filed Nov. 22, 1985, entitled IMPROVED PIVOTING ATHLETIC SHOE, and of my copending patent application Ser. No. 854,409, filed Apr. 21, 1986, entitled IMPROVED PIVOTING ATHLETIC SHOE. Patent application Ser. No. 854,409, now U.S. Pat. No. 4,669,204, is a continuation-in-part of patent application Ser. No. 800,740, now U.S. Pat. No. 4,660,304, which in turn is a continuation-in-part of my patent application Ser. No. 565,746, filed Dec. 27, 1983, entitled ATHLETIC SHOE WITH IMPROVED PIVOT CLEATING, now U.S. Pat. No. 4,577,422.

FIELD OF THE INVENTION

This invention is related generally to athletic shoes of the type having cleats, such as soccer shoes and the like, and, more specifically, to athletic shoes and shoe soles with cleating facilitating pivoting movements.

BACKGROUND OF THE INVENTION

Most athletic shoes used for field sports, such as soccer, football, baseball, softball and lacrosse, have a number of either tapered or blade-like cleats for the purpose of increasing traction. Cleats dig into the turf to prevent slipping during starting, stopping, and cutting maneuvers.

Such cleats, however, in addition to providing desirable traction for starting, stopping and cutting, typically provide very undesirable resistance to pivoting. This can be a disadvantage in two ways.

When pivoting is inhibited, the maneuverability of the athlete is limited. His performance is less than it could be. Enhancing the ability of a player to pivot can greatly increase his effectiveness on the field.

In addition to inhibiting certain pivoting actions which athletes attempt or would like to attempt, many cleats of the prior art tend to resist turning movements which can relieve stresses within the leg when unwanted torque or force is applied to the athlete, particularly to the athlete's leg. If a twisting moment is forcibly applied to a leg at a time when the cleats are firmly planted into the turf and release from the turf is not possible, injuries can result, particularly common knee injuries.

Some athletic shoes have cleats intended to accommodate pivoting movements. One approach has used fixed annular cleats. The performance of such shoes can vary greatly, depending on various factors However, the annular-cleated athletic shoes of the aforementioned U.S. patents provide greatly improved pivotability and excellent traction, and reduce the chance of athletic injuries.

The improvement in pivotability made possible with shoes in accordance with the principles of such patents is dramatic, and such shoes give the athletes wearing them a natural feeling of freedom together with a good feeling of traction for stopping, starting and cutting.

The invention described and claimed herein relates generally to athletic shoes having substantially continuous annular cleats. The substantially continuous annular cleats are modified to provide particular advantages In some cases, modifications in the annular cleat can significantly improve the performance of such shoes.

While good pivotability is highly desirable, in certain cases it is desirable to control the degree of pivotability, but to do so without eliminating or substantially reducing the ability of the shoe to pivot while firmly planted. That is, without losing the pivotability characteristic which serves to avoid knee injuries and other leg injuries, having a measure of control in pivoting would be desirable.

Because of their structural characteristics, annular cleats can tend to reduce sole flexibility to come extent But having a high degree of sole flexibility is desirable because it gives the shoes a natural feeling, allowing the normal bending of the sole of the foot to be expressed through the sole of the shoe.

A high degree of sole flexibility is considered of particular importance in certain field sports, such as soccer, where complete control of foot movements is advantageous. The fine foot movements which are used in soccer for ball control are particular examples. Thus, having means to improve sole flexibility without sacrificing the advantages of pivotability would be desirable.

It is also believed that sole inflexibility can tend to be a negative factor with respect to sole wear characteristics, causing undue pressures at certain points in the sole. Having means to improve the degree of sole flexibility could be desirable in this respect, improving sole durability.

Another concern with cleated sports shoes is the accumulation of mud in the cleats. While mud accumulation is not as significant a problem for the annular-cleated shoes of the aforementioned patents as it is for standard cleated athletic shoes, mud accumulation remains a concern, particularly for players of light weight. Increased sole flexibility can tend to further improve the mud-shedding qualities of such shoes. For this and other reasons, increased sole flexibility is especially important for lightweight athletes.

Good penetration of the ground is essential to obtaining excellent traction in cleated athletic shoes. There remains a need for still further improvement in shoe traction and hence in shoe penetration, in order to achieve higher levels of athletic performance. Good penetration ability is particularly important to lightweight athletes, since penetration is aided by greater weight. This is particularly so if mud is present in the cleats in position to block or retard ground penetration.

Good ground penetration is also helpful for obtaining good pivotability in the annular cleated shoes. Insufficient penetration will result in less ground bearing than is needed for the best possible improved pivotability.

Ground penetration will be affected by, among other things. the total cleat end area—that is, the total area of the distal surface(s) of the cleat or cleats. In general, the greater the total end area bearing on the ground, the more difficult it may be for an annular cleat to penetrate the ground; the smaller the total end area bearing on the ground, the easier is may be for an annular cleat to penetrate the ground. This affect is accentuated when the ground is hard.

Sharpening the distal end of the annular cleat reduces the total area of the distal surface and tends to enhance penetration, but may also cause some concern about possible injury from player contact with such sharp edges. With of these conflicting concerns, there is a need for an improved athletic shoe sole with cleating providing good ground penetration to insure the aforementioned excellent combination of traction and pivotability in a comfortable functional athletic shoe.

Good traction in various athletic movements on the playing field is of great importance. In particular, quick stopping ability is very important. Good ability to stop quickly from forward movement is helpful in many sports; good ability to stop quickly from rearward (backpedaling) movement is helpful as well. particularly for certain players such as those in defensive positions in soccer and football. There is a need for an improved athletic shoe with enhanced stopping ability.

In many cases, an athlete in a quick backing/stopping/advancing sequence of motions finds it necessary to turn his feet sideways, at least to some extent, on reversing from the backward to the forward direction. Turning the feet sideways can take time at a time when split seconds may be important.

There is a need for an improved athletic shoe sole providing an athlete good traction in such maneuvers without the need to turn his feet sideways. And, there is a need for a sole giving improved traction on starting and accelerating.

It has been found that in some forms athletic shoes in accordance with the aforementioned U.S. Pat. No. 4,577,422 may make a snapping or clapping sound during running on wet ground—particularly when an athlete is running backwards. Opinions may differ on whether this is a negative, neutral or even a positive trait. On balance, however, eliminating or reducing such noise would be desirable.

Before describing the invention, a brief description of the foot and its pivoting and planted positions will be helpful. This can serve as an aid in understanding preferred embodiments of this invention.

The sole of the foot includes four basic portions. These are, in order back to front: the heel portion; the arch portion; the ball-of-the-foot portion; and the toe portion. The heel portion and the ball-of-the foot portion are those portions which share most if not all of the player's weight when the player is in a normal standing position with his feet generally flat on the ground. In such position, the arch portion and toe portion bear little if an weight.

When a player is "on his toes" in a "ready" position, virtually all of the player's weight is normally shared by the toe portion and the ball-of-the-foot portion. The same is usually true when a player is "digging" in a running action. Indeed, when a player is in the ready position the juncture of the phalanges (toe bones) and the metatarsals is the center of weight bearing. In other words, the center of weight bearing in the forward portions of the foot actually moves forward when a player shifts to the ready position.

The sole of an athletic shoe has portions immediately below such four foot portions which may be designated, and herein are designated, by the same terms.

OBJECTS OF THE INVENTION

It is an object of this invention to provide an improved pivoting athletic shoe.

Another object of this invention is to provide an athletic shoe with improved pivotability and excellent traction.

Another object of this invention is to provide an improved athletic shoe which reduces the risk of common injuries, such as knee injuries.

Another object of this invention is to provide an athletic shoe with a substantially continuous annular cleat which penetrates the ground well to enhance its improved pivotability and good traction.

Another object of this invention is to provide a pivoting athletic shoe having good pivotability with a measure of pivoting control.

Yet another object of this invention is to provide an athletic shoe which controls pivoting while reducing the risk of injuries such as knee injuries.

Another object of this invention is to provide a pivoting athletic shoe which has good sole flexibility to improve its comfort and performance.

Another object of this invention is to provide a pivoting athletic shoe with improved durability.

Another object of this invention is to provide a pivoting athletic shoe having improved mud shedding ability.

Still another object of this invention is to provide a pivoting athletic shoe allowing improved traction during certain athletic maneuvers.

Another object of this invention is to provide a pivoting athletic shoe with improved traction for quick stopping, and for improved performance in sequential backing/stopping/advancing movements common, for example, for defensive positions in football and soccer.

Another object of this invention is to provide a pivoting athletic shoe allowing improved traction in starting and accelerating movements on the athletic playing field.

Another object of this invention is to provide an athletic shoe of the type having a substantially continuous annular cleat which makes little or no snapping or clapping sound when used on wet fields.

These and other objects will be apparent from the invention descriptions which follow.

BRIEF SUMMARY OF THE INVENTION

This invention is an improved sole for an athletic shoe for field sports providing excellent controlled pivotability and traction, and overcoming certain problems and deficiencies noted above. The sole of this invention provides improved ground penetration; improved sole flexibility; improved mud-shedding ability; excellent sole durability; and improved performance characteristics, including stopping, starting, and accelerating characteristics.

The athletic shoe sole of this invention includes a main sole surface and an annular cleat projecting therefrom and terminating in a distal edge. The distal edge, a major portion of which is preferably in a plane spaced from the main sole surface, is preferably flat and somewhat blunt. The distal edge has breaks in it along its opposite sides which provide significant advantages, including those enumerated above.

The annular cleat extends along a substantially circular path which encompasses a major area of the ball-of-the-foot and toe portions and is centered substantially on the juncture of such sole portions. Such substantially circular path includes or encloses most of the ball-of-the-foot and toe portions, and is forward of the arch portion, as defined above. The substantially circular path along which the annular cleat extends has opposed main lateral portions which are centered substantially on the juncture of the ball-of-the-foot and toe portions of the sole.

The annular cleat has opposed breaks in it along its distal edge, such breaks being in such opposed main lateral portions. The opposed breaks substantially increase sole flexing and bending ability. The opposed breaks in such opposed main lateral portions may take various forms.

In some cases, the breaks each have a forward wall which is tapered to widen the break toward the distal edge of the annular cleat and a rearward wall which is substantially normal (that is, perpendicular) to the main sole surface. In such configuration, traction when stopping from forward movement is enhanced. In other cases, the breaks have their rearward walls tapered to widen the break toward the distal edge and their forward walls substantially normal to the main sole surface. This tends to improve traction when stopping from movement in a rearward direction, and improves traction when starting and accelerating in a forward direction.

In one preferred embodiment, the opposed breaks in the opposed main lateral portions of the annular cleat include a single break along each main lateral portion, such single break extending to the main sole surface along the complete length and width of each such break. This forms a flexing region of some width across the sole, extending on either side of the juncture of the ball-of-the-foot and toe portions.

In such configurations, it is preferred that the forward and rearward walls of each single break be substantially normal to the main sole surface. This provides good stopping and starting traction in both the forward and rearward directions.

In other highly preferred embodiments, the opposed breaks comprise a pair of breaks along each main lateral portion. each pair defining therebetween one of two opposed annular cleat side portions on the juncture of the ball-of-the-foot and toe portions. Such embodiments accommodate a central cleat which may be located midway between the opposed annual cleat side portions on a line between the midpoints thereof. This allows the advantage of a central cleat, which can serve as a focal point for pivoting motions, without interfering with the sole flexibility which is provided by virtue of the opposed breaks.

In embodiments having a pair of breaks on each of the opposed main lateral portions, it is preferred that the forward and rearward walls of each break be tapered in a particular manner. In one embodiment, the breaks each have forward walls which are tapered to widen the breaks toward the distal edge and the rearward walls are substantially normal to the main sole surface, such that traction when stopping from forward movement is enhanced. However, when stopping from movement in a rearward direction is particularly important, the reverse configuration is preferred. In such cases, the breaks have rearward walls which ar tapered to widen the breaks toward the distal edge and forward walls which are substantially normal to the main sole surface. The latter configuration is particularly suitable for defensive players who must backpedal, then suddenly stop and accelerate in a forward direction.

The walls of the breaks which are normal to the main sole surface have a greater tendency to temper pivotability than the tapered walls. It is noted that pivotability in clockwise or counter-clockwise directions can be facilitated or tempered by orienting the walls of the breaks accordingly, including having opposite tapering on opposite sides of the annular cleat, as desired.

When the walls of the breaks in the annular cleat are substantially normal to the main sole surface, improved digging contact is provided. This, and the improved sole flexibility provided by this invention, make it less needful for an athlete who is backpedaling to turn his feet sideways when braking and then quickly accelerating in a forward direction.

The opposed breaks in each of the forms described above greatly improve sole flexibility, as already noted. Sole flexibility can be further enhanced by placing very shallow grooves across the sole between pairs of opposed breaks. When there are two breaks along each of the opposed main lateral portions, a pair of grooves can be used to extend across the sole on a line between the deepest portions of opposite breaks.

The opposed breaks provide another important advantage: They reduce the total surface area of the annular cleat distal edge which must penetrate into the ground. This in turn improves ground penetration, with a resulting improvement in traction and improved ground bearing for better pivotability.

It has been found that the benefits of improved pivotability and excellent traction provided by the athletic shoe described in U.S. Pat. No. 4,577,422 are further enhanced and made more practically useful by the improvements described and claimed herein.

As earlier noted, the distal edge of the annular cleat, a major portion of which is preferably in a plane spaced from the main sole surface, is preferably a flat surface. This bluntness improves the safety of the shoe. And, in the configuration of this invention such bluntness does not significantly detract from the ground penetration which is needed for good traction and pivotability.

In certain embodiments, a rear passageway is formed by the annular cleat between the main sole surface and the aforementioned plane. Such rear passageway extends across a portion of the width of the sole, between first and second positions which are on the ball-of-the-foot portion of the sole and near the arch portion, each being spaced rearwardly from one of the opposed main lateral portions.

In a particularly preferred form of such embodiments, the annular cleat is shortened between the aforementioned first and second positions, and the distal edge forms a concave length between such positions. Such concave length has a center portion converging toward the main sole surface so that the annular cleat is progressively shorter in length at positions progressively closer to the midpoint between the first and second positions.

A rear passageway can take other forms instead. For example, rather than a shortening of the annular cleat there can be an elimination of such cleat between the aforesaid two positions. Surprisingly, such void, in the position just forward of the arch portion of the sole, does not detract from the pivoting performance of the shoe, even though such void is on the ball-of-the-foot portion of the sole.

Such rear passageway, along with the aforementioned opposed breaks, provides important advantages. Eliminating or drastically shortening the rear portion of the annular cleat allows a still greater amount of the weight of the athlete to be applied to the ground through the remaining portions of the cleat. This further improves the degree of ground penetration and helps to insure good traction and provide a good base for pivoting. Having such a rear passageway also improves sole flexibility in the sole area across the rear of the cleat.

The annular cleat, rather than being a number of widely separated individual cleats, remains a single cleat and is appropriately described as "substantially continuous," despite the various cleat characteristics described herein.

The aforementioned breaks and passageway also allow air to pass out of the space enclosed by the annular cleat, the main sole surface, and the ground as the sole bites into the ground. This tends to reduce or even eliminate the aforementioned clapping sound. Such sound was caused, it is believed, by air compressed within such space being suddenly released through a small space such as any irregularity in the ground.

The annular cleat preferably has radially-inward and outward annular lateral surfaces which converge to the distal edge. The outward lateral surface preferably is normal to main sole surface. This helps to provide as wide a base as possible to support the foot of the athlete. The inward lateral surface preferably flares radially outwardly to the distal edge and is curved in cross-section to merge gently with the main sole surface. This tends to further minimize the accumulation of mud.

The annular cleat preferably is centered beneath the juncture of the phalanges and metatarsals, that is, at the juncture of the ball of-the-foot and toe portions of the sole. All non-cleat areas of the sole area enclosed by such annular cleat are preferably coincident with the main sole surface, that is, not substantially built up. This allows full turf penetration by the annular cleat. In preferred embodiments, the circular cleat is the forwardmost cleat on the shoe.

DETAILED DESCRIPTION OF PREFERRED EMBODIMENTS

The figures illustrate three athletic shoe soles 12, 13 and 14 in accordance with this invention. Soles 12, 13, and 14 are affixed to shoe uppers in the normal way. The uppers are of conventional materials like leather, canvas, nylon mesh and other synthetics, but their construction is not part of the invention. The soles are of a material like polyurethane, nylon, rubber, or blends (like nylon-polyurethane), which is wear-resistant but can flex in the normal manner depending on how weight is applied.

The lower surfaces of soles 12, 13 and 14, which contact the surface of the playing field, each include a main sole surface 16 which is a generally flat even surface from which cleats project. The cleats are preferably integrally formed with main sole surface 16 in a molding process of well-known type.

Figure 1:
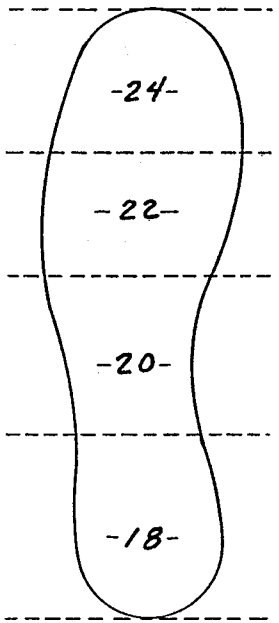
FIG. 1 is a cleatless schematic plan view of an athletic shoe sole, illustrating the portions thereof.

As illustrated in schematic FIG. 1, the sole has four portions which are defined by the portions of the foot adjacent to them. These are: a heel portion 18, immediately below the player's heel; an arch portion 20, below the arch of the player's foot; a ball-of-the-foot portion 22, below the ball of the player's foot; and a toe portion 24, below the player's toes.

As previously noted, the ball of the foot and the heel bear weight when the player is standing in a flat-footed stance, while the toe and ball-of-the-foot portions bear weight when the player is in the ready position.

Annular cleats 25, 26 and 27 project from main sole surfaces 16 of soles 12, 13 and 14, respectively. Annular cleats 25, 26 and 27 are each centered on the juncture of the ball-of-the-foot and toe portions 22 and 24, and extend along a substantially circular path all of which is forward of arch portion 20. Such circular paths of the annular cleats each encompass a major area which includes most of ball-of-the-foot and toe portions 22 and 24.

Annular cleats 25, 26 and 27 each enclose a sole area 30 all of which, except for a center cleat 28 on soles 12 and 13, hereafter described, is coincident with main sole surface 16. That is, there are no substantial built-up portions in enclosed sole area 30 which can retard penetration of the playing surface by annular cleats 25, 26 and 27, and, in the case of soles 12 and 13, by center cleat 28 as well. Sole area 30, however, may have texturing or other surface characteristics of minor vertical dimension.

As mentioned above and as illustrated in FIGS. 2, 5 and 6, a single standard frustoconical center cleat 28 is located at or very close to the center point of the sole area defined by each of the annular cleats 25 and 26 or soles 12 and 13. Cleat 28 serves as an additional traction means at the focal point of pivoting.

Annular cleats 25, 26 and 27 each terminate in a distal edge 32 which is preferably a flat surface, as shown. Such bluntness of distal edge 32 improves the safety of the shoes. Distal edge surface 32 includes a major portion 34 substantially in a single plane (except, of course, when the sole is flexed). The plane defined by the major portion 34 of distal edge 32 is useful in describing certain preferred features of the soles of this invention.

Each of the substantially circular paths followed by annular cleats 25, 26 and 27 of soles 12, 13 and 14 has two opposed main lateral portions 60 and 62 which are centered substantially on the juncture of the ball-of-the-foot and toe portions 22 and 24 of the sole. Along main lateral portions 60 and 62 the annular cleats are at substantially their closest positions with respect to the inside and outside sole edges 64 and 66, respectively. Main lateral portions 60 and 62 are called inside and outside main lateral portions, respectively.

Referring now specifically to sole 12, shown in FIGS. 2–6, annular cleat 25 has first and second opposed breaks 68 and 70 along each of opposed main lateral portions 60 and 62. Breaks 68 and 70 extend from distal edge 32 to main sole surface 16. Each pair of breaks 68 and 70 define therebetween one of two opposed annular cleat side portions 72 and 74 on the juncture of ball-of-the-foot and toe portions 22 and 24 of sole 12.

Center cleat 28, previously described, and opposed annular cleat side portions 72 and 74 are arranged such that center cleat 28 is located between side portions 72 and 74, substantially on a line between the midpoints of such side portions. This arrangement facilitates flexing and bending of sole 12 along the line between the two first opposed breaks 68 and along the line between the two second opposed breaks 70. Thus, superb flexing and bending are possible near the juncture of ball-of-the-foot and toe portions 22 and 24 without sacrificing center cleat 28 and the traction and pivoting advantages which it provides.

Along each of these two flex lines is a shallow groove 76 in main sole surface 16, running parallel to the juncture of ball-of-the-foot and toe portions 22 and 24 such that the flex lines define flex regions, said main sole surface being free of structural interruption across the flexing regions. Grooves 76, which are on the order of 1 mm. in depth, further facilitate flexing of sole 12. While grooves 76 are preferred features, main sole surface 16 can instead be flat, or in some cases, slightly raised lines can extend across sole 12 at the same locations.

Referring primarily now to FIGS. 3–6, each of the four breaks 68 and 70 has a forward wall 78 which is tapered such that the break is wider toward distal edge 32 of annular cleat 25. Each of the four breaks 68 and 70 also has a rearward wall 80 which is substantially normal to main sole surface 16. The front tip of the shoe sole in FIGS. 3–5, and in the other figures as well, is identified by numeral 77 for ease in understanding the break configurations. The break configurations shown in FIGS. 3–5 enhances traction when stopping quickly from forward movement. It also provides a measure of control in pivoting.

Figures 2, 3, 4, 5, 6, 7, 8:
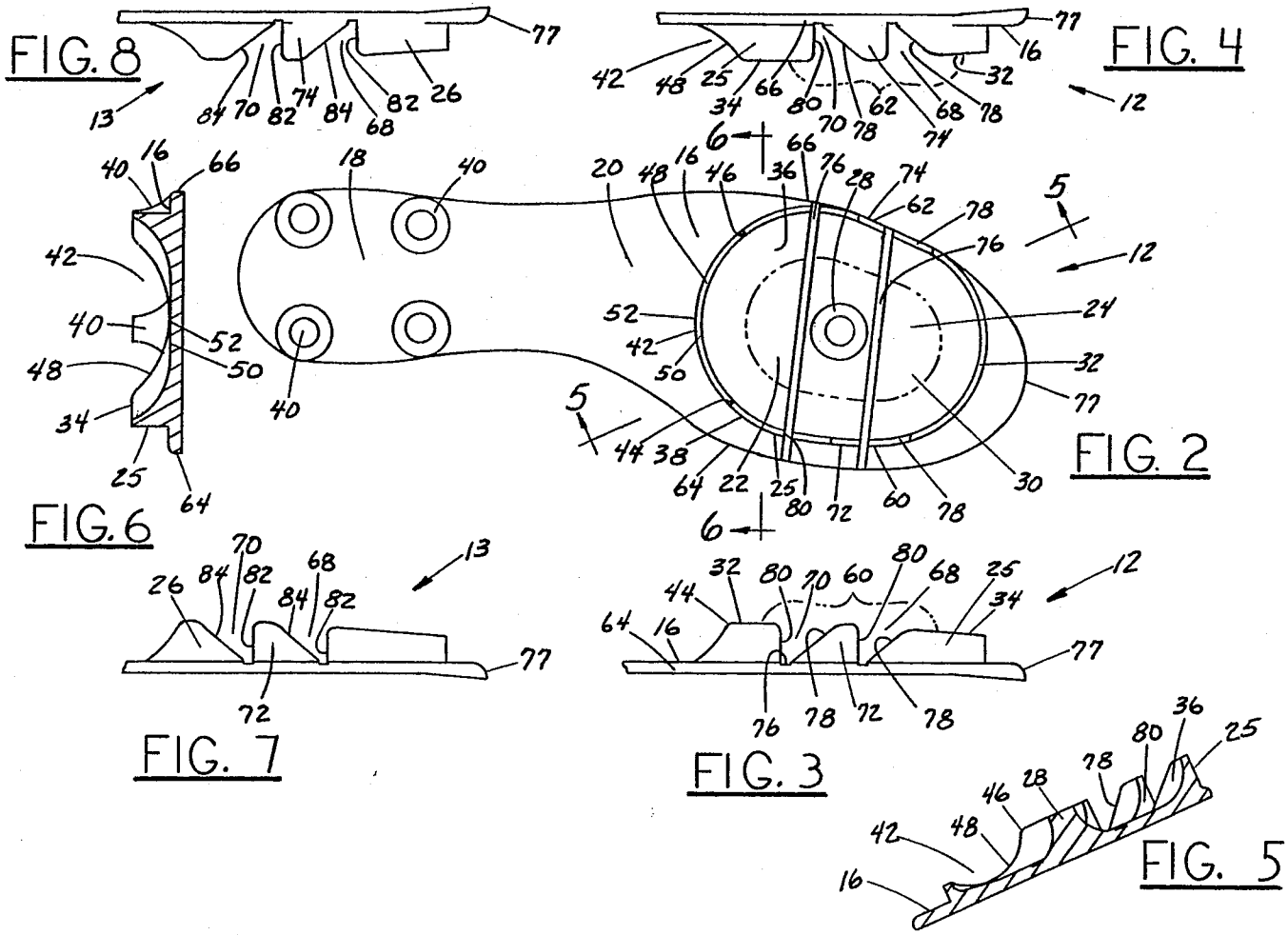
FIG. 2 is a plan view of a preferred athletic shoe sole in accordance with this invention.
FIG. 3 is a fragmentary bottom view of FIG. 2.
FIG. 4 is a fragmentary top view of FIG. 2.
FIG. 5 is a sectional view, taken along section 5—5 as indicated in FIG. 2.
FIG. 6 is a fragmentary sectional view, taken along section 6—6 as indicated in FIG. 2.
FIGS. 7 and 8 are views comparable to FIGS. 3 and 4, respectively, illustrating an alternate embodiment of this invention.

FIGS. 7 and 8 illustrate a variation of the break configuration just described. The tapering of the break walls is reversed in annular cleat 26 of sole 13. Each of the breaks in sole 13 has a forward wall 82 which is normal to main sole surface 16 and a rearward wall 84 which is tapered such that the break is wider toward distal edge 32. This break configuration enhances traction when stopping quickly from rearward movement and when starting and/or accelerating in forward movement. It is particularly advantageous for certain movement sequences frequently used by defensive specialists, as described above.

Another feature of soles 12 and 13 is the rear passageway 42 along a portion of the annular cleat 26. Rear passageway 42 is between the aforementioned plane, defined by major portion 34 of distal edge 32 of each of the annular cleats 25 and 26, and main sole surface 16. In the preferred form shown in the drawings, rear passageway 42 extends across a portion of the width of the sole between first and second positions 44 and 46, which are on ball-of-the-foot portion 22 near arch portion 20, each spaced rearwardly from one of the opposed main lateral portions 60 and 62. Positions 44 and 46 are both along the circular paths along which annular cleats 25 and 26 extend.

Between first and second positions 44 and 46, distal edge 32 is positioned at a level between main sole surface 16 and the plane defined by major portion 34 of distal edge 32. As best illustrated in FIG. 6, the portion of distal edge 32 between first and second positions 44 and 46 forms a concave length 48. Concave length 48 has a center portion 50 which converges toward main sole surface 16, such that annular cleat 26 is progressively shorter in length at positions progressively closer to the mid-point 52 between first and second positions 44 and 46.

A rear passageway can be in a variety of forms. Instead of the preferred form shown in the drawings, in which the annular cleat is, in effect, drastically shortened, distal edge 32 can merge with main sole surface 16 such that a more complete void is along a minor portion of the circle along which the annular cleat runs, at or near the position just forward of arch portion 20. Such void, in the position just forward of arch portion 20, does not detract from the pivoting performance of the shoe.

Rear passageway 42 and breaks 68 and 70 provide certain other advantages. Their presence means that the athlete's weight is more concentrated on the ground through major portion 34 of distal edge 32. This helps to insure that the annular cleat will penetrate the ground sufficiently to provide good traction, and to provide a good base for pivoting.

Furthermore, breaks 68 and 70 and rear passageway 42 allow passage of air out of the space enclosed by the annular cleat, main sole surface 16, and the ground as the player's foot bites into the ground. This reduces or eliminates the clapping sound which can occur if air is compressed within such space and then suddenly is released through a small passageway, such as an irregularity in the ground.

Figure 11:
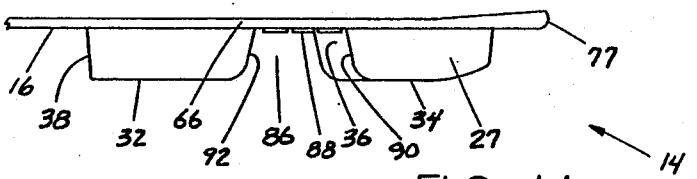
FIGS. 10 and 11 are fragmentary bottom and top views, respectively, of FIG. 9.
Figure 9:
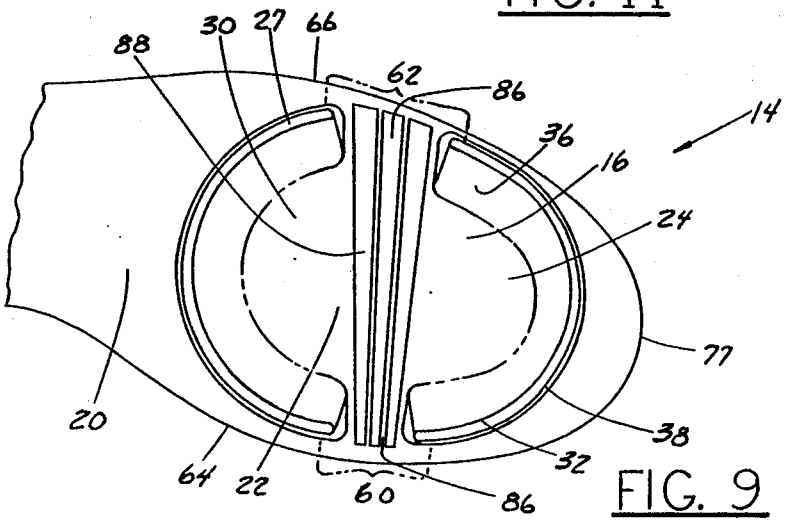
FIG. 9 is a fragmentary plan view of still another embodiment of this invention.
Figure 10:
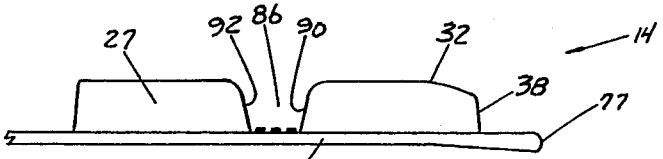

Turning now specifically to athletic shoe sole 14, illustated in FIGS. 9–11, annular cleat 27 has a single break 86 along its distal edge in each of the opposite sides. More specifically, a single break 86 is in annular cleat 27 along its inside main lateral portion 60, and a single break is in annular cleat 27 along its outside main lateral portion 62.

Each of the breaks 86 extends to main sole surface 16 along substantially the complete length and width of the break. Such wide, substantially non-tapered break configuration forms a flexing region 88 extending across sole 14 on either side of the junction of ball-of-the-foot and toe portions 22 and 24. Flexing region 88 provides excellent sole bendability, yet does not detract substantially from the pivoting qualities of the sole.

Each single break 86 has a forward wall 90 and rearward wall 92 which are substantially normal to main sole surface 16. This break configuration enhances stopping and starting traction in both the forward and rearward directions, and is particularly useful for athletes whose positions require quick forward/backward changes of direction for whatever reason.

Sole 14 provides excellent penetration of the ground and therefore provides excellent traction. And, as noted, the pivoting qualities of sole 14 are exellent.

Annular cleats 25, 26 and 27 each have radially-inward and outward annular lateral surfaces 36 and 38 which converge to distal edge 32. Outward lateral surface 38 is normal to main sole surface 16, thus providing as wide a base as possible to support the foot of the athlete. Inward lateral surface 36 flares radially outwardly to distal edge 32, and is curved in cross-section to merge gently with main sole surface 16, thus minimizing nooks and crannies in which mud might accumulate. Such gentle merging can be described by referring to main sole surface 16 as joining inward lateral surface 36 tangentially.

A number of generally frustoconical cleats 40 are formed on heel portion 18 of soles 12, 13 and 14. A variety of heel cleats may be used on the shoe of this invention. The heel cleat characteristics do not form part of this invention.

While the principles of this invention have been described in connection with specific embodiments, it should be understood clearly that these descriptions are made only by way of example and are not intended to limit the scope of the invention.

What is claimed is:

1. In an athletic shoe sole of the type having a main sole surface and cleats extending therefrom, and having heel, arch, ball-of-the-foot and toe portions, the improvement comprising:

an annular cleat having a distal edge, said cleat extending along a substantially circular path which encompasses a major area of the ball-of-the-foot and toe portions and is, and has opposed main lateral portions which are, centered substantially on the juncture of the ball-of-the-foot and toe portions;

opposed breaks in the annular cleat along the distal edge in the main lateral portions, said opposed breaks extending from the distal edge to the main sole surface; and a flexing region formed between said opposed breaks and extending entirely across the sole substantially along the juncture of the ball-of-the-foot and toe portions, said flexing region being substantially coplanar with the main sole surface and the main sole surface being free of structural interruption across the flexing region, whereby substantial sole flexibility is provided at said juncture in a sole providing excellent pivotability and traction.

2. The athletic shoe sole of claim 1 wherein the opposed breaks comprise a single break along each main lateral portion extending substantially to the main sole surface along substantially the complete length and width of each such break to form the flexing region, said flexing region extending on either side of said juncture.

3. The athletic shoe sole of claim 2 wherein the single break has forward and rearward walls substantially normal to the main sole surface.

4. The athletic shoe sole of claim 1 wherein the opposed breaks comprise a pair of breaks along each main lateral portion, each pair defining therebetween one of two opposed annular cleat side portions on said juncture.

5. The athletic shoe sole of claim 4 further including a central cleat midway between the opposed annular cleat side portions on a line between the midpoints thereof.

6. The athletic shoe sole of claim 1 wherein a major portion of the distal edge defines a plane spaced from the main sole surface, and further comprising a rear passageway in the cleat between the main sole surface and said plane, said rear passageway extending across a portion of the width of the sole between first and second positions which are on the ball-of-the-foot portion and are each spaced rearwardly from one of the opposed main lateral portions.

7. The athletic shoe sole of claim 6 wherein between the first and second positions the distal edge forms a concave length which has a center portion converging toward the main sole surface, such that the annular cleat is progressively shorter in height at positions progressively closer to a point between the first and second positions.

8. The athletic shoe sole of claim 7 wherein the opposed breaks comprise a pair of breaks along each main lateral portion, each pair defining therebetween one of two opposed annular cleat side portions on said juncture.

9. The athletic shoe sole of claim 8 further including a central cleat midway between the opposed annular cleat side portions on a line between the midpoints thereof.

10. In an athletic shoe sole of the type having a main sole surface and cleats extending therefrom, and having heel, arch, ball-of-the-foot and toe portions, the improvement comprising:

an annular cleat having a distal edge, said cleat extending along a substantially circular path which encompasses a major area of the ball-of-the-foot and toe portions and is, and has opposed main lateral portions which are, centered substantially on the juncture of the ball-of-the-foot and toe portions; and opposed breaks in the annular cleat along the distal edge in the main lateral portions, at least one of the breaks having a forward wall tapered to widen the break toward the distal edge and a rearward wall substantially normal to the main sole surface, whereby traction when stopping from forward movement is enhanced.

11. In an athletic shoe sole of the type having a main sole surface and cleats extending therefrom, and having heel, arch, ball-of-the-foot and toe portions, the improvement comprising:

an annular cleat having a distal edge, said cleat extending along a substantially circular path which encompasses a major area of the ball-of-the-foot and toe portions and is, and has opposed main lateral portions which are, centered substantially on the juncture of the ball-of-the-foot and toe portions; and opposed breaks in the annular cleat along the distal edge in the main lateral portions, at least one of the breaks having a rearward wall tapered to widen the break toward the distal edge and a forward wall substantially normal to the main sole surface, whereby traction when stopping from rearward movement is enhanced.

12. The athletic shoe sole of claim 10 wherein the opposed breaks comprise a pair of breaks along each of the main lateral portions, each pair defining therebetween one of two opposed annular cheat side portions on said juncture.

13. The athletic shoe sole of claim 11 wherein the opposed breaks comprise a pair of breaks along each of the main lateral portions, each pair defining therebetween one of two opposed annular cleat side portions on said juncture.

14. In an athletic shoe sole of the type having a main sole surface and cleats extending therefrom, and having heel, arch, ball-of-the-foot and toe portions, the improvement comprising:

an annular cleat having a distal edge, said cleat extending along a substantially circular path which encompasses a major area of the ball-of-the-foot and toe portions and is, and has opposed main lateral portions which are, centered substantially on the juncture of the ball-of-the-foot and toe portions;

opposed breaks in the annular cleat along the distal edge in the main lateral portions; and a groove in the main sole surface extending across the sole between opposed breaks, whereby sole flexibility is enhanced.

15. In an athletic shoe sole of the type having a main sole surface and cleats extending therefrom, and having heel, arch, ball-of-the-foot and toe portions, the improvement comprising:

an annular cleat having a distal edge a major portion of which defines a plane spaced from the main sole surface, said cleat extending along a substantially circular path which encompasses a major area of the ball-of-the-foot and toe portions and is, and has opposed main lateral portions which are, centered substantially on the juncture of the ball-of-the-foot and toe portions; and a pair of breaks in the annular cleat along each of the main lateral portions, each pair defining therebetween one of two opposed annular cleat side portions on the juncture of the ball-of-the-foot and toe portions, said breaks having forward walls tapered to widen the breaks toward the distal edge and rearward walls substantially normal to the main sole surface whereby traction when stopping from forward movement is enhanced; and a rear passageway in the cleat between the main sole surface and said plane, said rear passageway extending across a portion of the width of the sole between first and second positions which are on the ball-of-the-foot portion and are each spaced rearwardly from one of the opposed main lateral portions, the distal forming, between the first and second positions, a concave length which has a center portion converging toward the main sole surface such that the annular cleat is progressively shorter in height at positions progressively closer to a point between the first and second positions.

16. In an athletic shoe sole of the type having a main sole surface and cleats extending therefrom, and having heel, arch, ball-of-the-foot and toe portions, the improvement comprising:

an annular cleat having a distal edge a major portion of which defines a plane spaced from the main sole surface, said cleat extending along a substantially circular path which encompasses a major area of the ball-of-the-foot and toe portions and is, and has opposed main lateral portions which are, centered substantially on the juncture of the ball-of-the-foot and toe portions; and a pair of breaks in the annular cleat along each of the main lateral portions, each pair defining therebetween one of two opposed annular cleat side portions on the juncture of the ball-of-the-foot and toe portions, said breaks having rearward walls tapered to widen the breaks toward the distal edge and forward walls substantially normal to the main sole surface whereby traction when stopping from rearward movement is enhanced; and a rear passageway in the cleat between the main sole surface and said plane, said rear passageway extending across a portion of the width of the sole between first and second positions which are on the ball-of-the-foot portion and are each spaced rearwardly from one of the opposed main lateral portions, the distal forming, between the first and second positions, a concave length which has a center portion converging toward the main sole surface such that the annular cleat is progressively shorter in height at positions progressively closer to a point between the first and second positions.

* * * * *